US005248587A

United States Patent [19]

Brust

[11] Patent Number: 5,248,587

[45] Date of Patent: Sep. 28, 1993

[54] LOW TEMPERATURE GROWTH EMULSION MAKING PROCESS

[75] Inventor: Thomas B. Brust, Spencerport, N.Y.

[73] Assignee: Eastman Kodak Company, Rochester, N.Y.

[21] Appl. No.: 601,649

[22] Filed: Oct. 23, 1990

[51] Int. Cl.[5] ..... G03C 1/015

[52] U.S. Cl. ..... 430/569; 430/567; 430/568

[58] Field of Search ..... 430/567, 569, 568

[56] References Cited

U.S. PATENT DOCUMENTS

| | | | |
|---|---|---|---|
| 3,790,387 | 2/1974 | Musliner | 430/569 |
| 4,184,878 | 1/1980 | Maternaghan | 430/567 |
| 4,297,439 | 10/1981 | Bergthaller et al. | 430/569 |
| 4,477,565 | 10/1984 | Himmelwright | 430/567 |
| 4,713,320 | 12/1987 | Maskasky | 430/567 |
| 4,722,886 | 2/1988 | Nottorf | 430/569 |
| 4,775,617 | 10/1988 | Goda | 430/567 |
| 4,798,775 | 1/1989 | Yagi et al. | 430/569 |

FOREIGN PATENT DOCUMENTS

| | | | |
|---|---|---|---|
| 0362699 | 4/1990 | European Pat. Off. | 430/567 |
| 3707135 | 9/1987 | Fed. Rep. of Germany | 430/567 |

*Primary Examiner*—Charles L. Bowers, Jr.
*Assistant Examiner*—Mark F. Huff
*Attorney, Agent, or Firm*—Paul A. Leipold

[57] ABSTRACT

The invention provides an improved method of forming monodispersed tabular silver halide grains. These and other objects of the invention are generally performed by providing a method of forming silver halide grains comprising forming an initial population of small twin plane silver halide grains in an aqueous medium, and allowing ripening at a temperature greater than or equal to the temperature of forming said initial population, and then growing the ripened grains. This process is carried out, such that during between about 10 percent and about 100 percent of growth, the temperature of said aqueous medium is at least 2° C. below the ripening temperature, but above the temperature of renucleation, and the pBr is between about 1.0 and 3.5 during growth.

4 Claims, No Drawings

LOW TEMPERATURE GROWTH EMULSION MAKING PROCESS

TECHNICAL FIELD

This invention relates to the field of photography. More particularly, the invention is directed to improvements in radiation sensitive silver halide emulsions.

BACKGROUND ART

In the late 1940's a transition in the manufacture of silver halide photographic products began away from the use of single jet emulsions toward to the use of double jet emulsions. The disadvantage of single jet emulsions was that they were polydisperse. They contained a wide range of grain shapes and sizes. This was the direct result of running silver salts into a halide salt solution of fixed volume in the reaction vessel and thereby varying the ratio of silver to halide continuously throughout the emulsion make.

In double jet precipitation both the halide and silver salts are concurrently introduced into the reaction vessel. Thus, it is possible to produce a grain population of little or no variance in grain shape and a very narrow distribution of grain sizes. Silver halide emulsions having a low variance of grain sizes are referred to as monodisperse emulsions.

Monodisperse emulsions are recognized to offer a variety of photographic advantages. For example, a larger percentage of the grains in a monodisperse emulsion can be optimally sensitized as a result of their similar surface areas. Fine grain populations, which disproportionately contribute to light scattering and therefore image sharpness reduction, are restricted. Larger grain populations, which contribute disproportionately to image granularity, are restricted. The reproducibility of the emulsions and their photographic performance rises as dispersity is reduced. Contrast of a single monodisperse emulsion is higher than that of polydisperse emulsion of the same mean grain size. Monodisperse emulsions are employed not only for photographic applications requiring higher contrast, but are also blended to achieve aim contrasts in photographic applications requiring relatively lower contrast, since a blended monodisperse emulsion retains photographic advantages over a polydisperse emulsion of the same mean grain size and contrast.

Maternaghan U.S. Pat. Nos. 4,150,994 and 4,184,878 are representative of early reported attempts to prepare tabular grain silver bromoiodide emulsions. Covering power advantages were postulated. Low coefficients of variation were reported for the emulsions. However, in retrospect this is not surprising, since from remakes and grain characterizations the average aspect ratios (most simply measured as mean grain diameter divided by mean grain thickness) of these emulsions are approximately 4:1.

Subsequent to Maternaghan, intensive investigations of high aspect ratio silver bromoioide emulsions were reported as well as procedures for their preparation. The average tabular grain aspect ratios of these emulsions were in all instances greater than 8:1. Wilgus et al U.S. Pat. No. 4,434,226, Kofron et al U.S. Pat. No. 4,439,520, Solberg et al U.S. Pat. No. 4,433,048, Daubendiek et al U.S. Pat. No. 4,414,310, Jones et al U.S. Pat. No. 4,478,929, Evans et al U.S. Pat. No. 4,504,570, and Maskasky U.S. Pat. No. 4,435,501 are representative of the earliest published teachings relating to high aspect ratio silver bromoiodide emulsions. More recently Daubendiek et al U.S. Pat. Nos. 4,693,964 and 4,672,027 have reported the preparation of high aspect ratio silver bromoiodide emulsions of much smaller mean grain diameters, referred to as small, thin tabular grain silver bromoiodide emulsions. Maskasky U.S. Pat. No. 4,713,320 illustrates the effect of gelatin methionine reduction on silver bromoiodide high aspect ratio tabular grain emulsion preparation.

The advantages of silver bromoiodide high aspect ratio tabular grain emulsions include an improved relationship between speed and granularity, sharper images—both in single and multilayer photographic elements, accelerated development, higher insensitivity to temperature variations during development, higher fixing rates, more favorable toning, higher covering power, an increased separation between minus blue (green or red) and blue speeds when spectrally sensitized to the minus blue portion of the spectrum, increased blue speed when spectrally sensitized to blue light, and a variety of other advantages observed in the context of specific photographic applications.

Although almost all silver bromoiodide high aspect ratio tabular grain emulsions are prepared by double jet precipitation techniques, difficulties were experienced from the outset in reducing the dispersity of the emulsions. Whereas regular grain emulsions produced by double jet precipitation (e.g., regular cubic or octahedral grain emulsions) can be readily prepared containing only the desired grain population, tabular grain emulsions are rarely prepared with only tabular grains present. Thus, having mixed populations of tabular and nontabular grains is one source of dispersity in tabular grain emulsions. The second source of dispersity is the dispersity variances within the tabular grain population itself, which is a function of the twinning followed by edge deposition growth pattern that distinguishes tabular grain emulsions from regular grain emulsions, wherein twinning is absent or rare and deposition favors no particular set of crystal faces. Further, dispersity in tabular grain emulsions increases as the average aspect ratios of the tabular grains increases. Therefore, dispersity levels which are easily attained in lower aspect ratio tabular grain emulsions have not been attainable at higher aspect ratios.

Himmelwright U.S. Pat. No. 4,477,565 and Sugimoto et al U.S. Pat. Nos. 4,609,621, 4,656,120, and 4,665,012 are illustrative of follow-on disclosures of variations in the preparation of high aspect ratio tabular grain silver bromoiodide emulsions.

It has been recognized from the outset of high aspect ratio tabular grain emulsion investigations that silver bromide tabular grain emulsions are much more readily prepared to exhibit both high aspect ratios and low levels of dispersity than corresponding silver bromoiodide emulsions. *Research Disclosure* Vol. 232, Aug. 10, 1983, Item 23212, (Mignot French Patent 2,534,036 corresponding) produced by a ripening procedure tabular grain silver bromide emulsions of average aspect ratios of 10, 12, and 25.6 with coefficients of variation of 15, 16, and 28.4, respectively. *Research Disclosure* and its predecessor *Product Licensing Index* are publications of Kenneth Mason Publications, Ltd., Emsworth, Hampshire P010 7DD, England. Saitou et al West German OLS 3,707,135 Al employs double and single jet precipitation techniques to produce silver bromide emulsions which exhibit higher coefficients of variation at aspect ratios comparable to those of Mignot, even though Saitou et al reports coefficients of variations based solely on the tabular grain population.

The prior processes while producing suitable emulsions for photographic uses nevertheless could be improved by formation of more monodisperse emulsions that have a higher coefficient of variation for thin tabular grains having an aspect ratio of greater than 8.

DISCLOSURE OF THE INVENTION

An object of this invention is to provide emulsions that have more uniform photographic response.

An additional object is to provide an improved method of forming monodispersed tabular silver halide grains of high aspect ratio and minimal grain thickness.

These and other objects of the invention are generally performed by providing a method of forming silver halide grains comprising forming an initial population of small twin plane silver halide grains in an aqueous medium, allowing ripening at a temperature greater than or equal to the temperature of forming said initial population, and then growing the ripened grains. This process is carried out, such that during between about 10 percent and about 100 percent of growth, the temperature of said aqueous medium is at least 2° C. below the ripening temperature, but above the temperature of renucleation, and the pBr is between about 1.0 and 3.5 during growth.

This invention is directed to a high aspect ratio tabular grain emulsion comprised of a dispersing medium and silver bromoiodide grains, wherein tabular silver bromoiodide grains having a thickness of below 0.06 μm account for greater than 50 percent of the projected area of the total silver bromoiodide grain population and such grains have an average aspect ratio of greater than 8. The emulsion is characterized in that the quotient of the average silver bromoiodide tabular grain aspect ratio divided by the coefficient of variation of the total silver bromoiodide grain population is greater than 1.2. The coefficient of variation of grains of the invention is preferably between about 30 and about 42.

MODES FOR CARRYING OUT THE INVENTION

The present invention provides in a single silver bromoiodide emulsion both the recognized advantages of silver bromoiodide high aspect ratio tabular grain emulsions and the art recognized advantages of monodispersity. Prior to the present invention it has been necessary to compromise either the average tabular grain aspect ratio, the tabular grain thickness, or the monodispersity of a silver bromoiodide emulsion. With the present invention a superior relationship of grain dispersity and high tabular grain aspect ratios is realized.

The invention has numerous advantages over prior processes. The grains have a greater coefficient of variation than silver halide grains produced by other processes that produce grains having a thickness of below 0.06 microns. Further the process has the advantage that the processing is generally similar to conventional processes and may be carried out in conventional equipment. Another advantage is that the grains produced by the invention are satisfactory for utilization in improved color photographic materials.

It has been the practice in the art to carry out growth at temperatures at least as great as those at which ripening has been carried out. However, it has now been found that by lowering the temperature of growth at least 2° C. below ripening temperature but above the temperature of renucleation while maintaining pBr between about 1.0 and about 3.5 during growth, an improved monodispersed emulsion may be obtained. Preferably, the growing temperature is between about 15° C. and about 40° C. less than ripening temperature for the most monodispersed thin tabular emulsions. At higher temperatures during growth, grains of lower aspect ratio are formed that are also generally less monodispersed.

It is preferred that the temperature be lowered during the beginning of the growth stage such that between about 10 percent and about 100 percent of growth is carried out at the lower temperature. It is preferred that during between about 30 percent and about 100 percent of the growth time that the temperature of the aqueous medium in which growth is taking place is lowered between about 5° C. and about 30° C. below the temperature of which ripening was carried out. Generally ripening may be carried out at between about 30° C. and about 90° C. The preferred ripening temperature is between about 45° C. and 80° C. when growth is to be carried out between about 5 and about 30 degrees centigrade below the ripening temperature.

A preferred tabular grain formed by the invention process is one in which the silver halide content is about 3 percent by weight silver iodide and about 97 percent by weight silver bromide. Further it is preferred that the iodide is added to the aqueous medium during growth and further that the iodide be added as a Lippman emulsion for formation of preferred grains for utilization in color negative photographic films.

The present invention is an improvement on the teachings of Wilgus et al U.S. Pat. No. 4,434,226, Kofron et al U.S. Pat. No. 4,439,520, Solberg et al U.S. Pat. No. 4,433,048, Daubendiek et al U.S. Pat. Nos. 4,414,310, 4,693,964 and 4,672,027, Evans et al U.S. Pat. No. 4,504,570, and Maskasky U.S. Pat. Nos. 4,435,501, 4,713,320, and Bryant et al EP 0 362 699, the disclosures of which are here incorporated by reference. All features of the emulsions of this invention, their preparation, and their photographic applications, except as otherwise indicated, are to be understood as being as described by these incorporated teachings.

The present invention is directed to silver bromoiodide tabular grain emulsions which exhibit an improved relationship of grain tabularity to dispersity. A detailed discussion requires more definitive terms.

As herein employed the term "high aspect ratio tabular grain emulsion" refers to an emulsion in which the tabular grains having a thickness of less than 0.06 μm have an average aspect ratio of greater than 8 and account for greater than 50% of the total grain projected area. The average aspect ratio of the tabular grains can be determined by determining the aspect ratio of each grain and averaging the aspect ratios of all tabular grains or by dividing the average diameter of all of the tabular grains by the average thickness of all the tabular grains.

The term "coefficient of variation" is employed in its art recognized sense as 100 times the standard deviation of all silver bromoiodide grain diameters divided by the average silver bromoiodide grain diameter. All grains, including both tabular and nontabular grains, are counted in arriving at averages. Defined in this way, the coefficients of variation reported have higher numerical values than those based solely on the tabular grain population. It is preferred that the grains of the invention have a coefficient of variation of less than 42.

When the average aspect ratio of the tabular silver bromoiodide grains of an emulsion of this invention is divided by the coefficient of variation of all of the silver bromoiodide grains present, a quotient of greater than 1.2 is obtained. This is a significantly higher quotient than is exhibited by any silver bromoiodide tabular grain emulsion heretofore known in the art. As shown in the examples below quotients of greater than 0.7, 0.8 and 1.0 can be realized by emulsion preparation procedures that have not been rigorously optimized. By routinely optimizing the emulsion preparation techniques of the examples in view of the general teachings of this specification it is recognized that quotients of about 1.2 and higher are attainable.

A reason for defining the invention in terms of the quotient of the average aspect ratio divided by the coefficient of variation rather than simply in terms of a minimum coefficient of variation is that coefficients of variation increase linearly with increases in the average aspect ratios of tabular grains using comparable processes of emulsion preparation. For silver bromoiodide emulsions having average aspect ratios in the 5:1 to 10:1 range monodispersities acceptable for present photographic performance requirements are readily achieved. However, at average aspect ratios greater than 12:1 and beyond the art has an unsatisfied need for higher levels of monodispersity. The present invention makes possible an improved balance of tabular grain average aspect ratios and monodispersity in the aspect ratio ranges where satisfaction of desired monodispersity have not been heretofore realized.

The preferred emulsions of the invention are those in which the tabular silver bromoiodide grains having a thickness of less than 0.06 μm have an average aspect ratio of greater than 8 (optimally at least 20). Very high average aspect ratios ranging up to 100 or more are contemplated. In the preferred form of the invention the tabular silver bromoiodide grains satisfying the thickness criteria above account for greater than 70 percent (optimally greater than 90 percent) of the total silver bromoiodide grain projected area. Ideally, of course, the emulsions of the invention consist essentially of tabular silver bromoiodide grains satisfying the thickness criteria above.

To satisfy normal photographic image definition requirements the means grain size (diameter) of the emulsions of this invention is less than 10 μm. While the invention can be employed to produce very small diameter (0.2 to 0.6 μm mean diameter) tabular grain emulsions, such as those disclosed by Daubendiek et al U.S. Pat. Nos. 4,672,027 and 4,693,964, as well as those having mean tabular grain diameters above 0.6 μm, as taught in the remaining incorporated by reference patent teachings, the present invention has particular preferred applicability to emulsions having mean grain diameters in the range of from 1.5 to 3.5 μm, particularly 1.5 to 2.5 μm.

The unique silver bromoiodide grain population required by the tabular grain emulsions of this invention has resulted from replacing the empirical methods of emulsion preparation disclosed in the art by a strategy for grain nucleation and growth specifically devised to preserve monodispersity in the context of silver bromoiodide tabular grain precipitation.

The strategy begins with dividing the emulsion precipitation process into three distinct stages:

(1) A nucleation stage in which all of the grains making up the emulsion come into existence as separate entities. This stage is specifically managed to minimize variance in the nuclei.

(2) A hold or ripening stage in which residual inequalities in grain nuclei are reduced.

(3) A growth stage in which residual inequalities in the grains, particularly at the onset of the growth stage, can be further reduced. The growth stage is, of course, controlled so that continued formation of grain nuclei does not occur.

While a variety of specific techniques are available for implementing the precipitation strategies, not all are of equal importance nor are all required. It is a recognition of this invention that grain variance elimination at the earliest possible opportunity is of paramount importance, since an early grain variance has a cascading effect on all subsequent stages of emulsion preparation.

An important single process variation for emulsions of this invention is to use a technique for as nearly concurrent formation of all of the grain nuclei as possible. In an aqueous solution supersaturated with silver and bromide ions precipitation occurs to produce a grain nucleus. This nucleus immediately begins to grow. Unless all nuclei are concurrently formed, the earlier formed nuclei will be larger than the later formed nuclei. In the precipitation processes demonstrated in the examples for preparing emulsions satisfying the requirements of the invention the concentrations of the aqueous silver and bromide salts added to the reaction vessel are increased and the duration of their addition is condensed into a period of less than 10 seconds. Preferably both silver and bromide salt additions are completed in less than 2 seconds. To accomplish this salt solution concentrations above 1 molar are preferred. This decreases the bulk of the materials to be introduced. Since the aim is to drive the silver and bromide ions out of solution as expeditiously as possible, temperature can be controlled to limit solubility. Whereas precipitation temperatures are known to range up to 90° C., it is preferred to limit temperatures at nucleation to 60° C. or less. Reducing the elapsed time of initial silver and bromide salt additions is important to uniform grain formation. Increasing salt concentrations and limiting temperature are preferred features of nucleation.

After creating the grains of the emulsion by nucleation, the next stage of the precipitation strategy is to reverse immediately the initial direction of net ion transfer from solution to nuclei, but in a controlled manner so that the majority of the nuclei remain. This is achieved by abruptly moving from a supersaturated solution to a solution which is below its silver and bromide ion saturation limit. The second stage is then a ripening stage in which the smaller silver halide nuclei disappear while the remaining nuclei remain. This can be achieved by employing any one or combination of known ripening procedures. The simplest of these is to adjust upwardly the temperature of the nuclei emulsion, thereby raising the solubility level of the silver and bromide ions. It is also possible to increase the pBr of the solution while remaining within the growth ranges taught in the art for silver bromoiodide tabular grain preparation. It is a generally understood feature of ripening that smaller grains suffer a net loss of silver and bromide ions while remaining grains exhibit a net increase. As smaller grain nuclei are eliminated by ripening, the overall effect is to narrow the grain size frequency distribution.

The duration of ripening in the second stage is preferably from 5 to 30 minutes in the absence of a ripening agent other than the dissolved bromide ion. The addition of known ripening agents, such as thioethers, thiocyanate, ammonia, and the like, accelerate ripening. If ammonia is employed as a ripening agent, it is preferably deactivated at the end of the ripening interval by an appropriate pH adjustment. The nuclei ripening procedure of Nottorf U.S. Pat. No. 4,722,886, here incorporated by reference, is specifically contemplated. This procedure alone, however, will not produce the emulsions of this invention.

At the end of the ripening stage a grain nuclei population is present which exhibits less grain to grain variation than at the end of the nucleation step. It is now possible to grow emulsions satisfying the requirements of this invention by employing conventional silver bromoiodide tabular grain growth conditions, such as those set forth in the incorporated teachings cited above in combination with the temperature limitations of the invention.

Iodide ion is introduced in the growth stage. The teachings of Solberg et al U.S. Pat. No. 4,433,048 disclose preferred considerations for iodide addition.

Generally the pBr of the reaction vessel during ripening and growth is between about 1.0 and about 3.5. It is generally preferred to adjust the pBr of the reaction vessel at the outset of the ripening stage to between 1.5 and about 2.5 for uniform grains. Further increase of the pBr will result in deposition onto the major faces of the tabular grains and reduce the average aspect ratio of the emulsion.

In one embodiment of the invention, the initial population of small twinned planed silver halide grains in an aqueous medium comprises silver bromide. In one embodiment of the invention during growth, iodide is rapidly added to said aqueous medium. In another embodiment of the invention, iodide is added as a liquid emulsion after about 5% to about 90% of the total silver has been added to the aqueous solution.

Modifying compounds can be present during silver bromoiodide precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium and tellurium), gold, and Group VIII noble metals, can be present during precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure*, Vol. 134, June 1975, Item 13452. The tabular grain emulsions can be internally reduction sensitized during precipitation, as illustrated by Moisar et al, *Journal of Photographic Science*, Vol. 25, 1977, pp. 19–27.

Once the silver bromoiodide high aspect ratio tabular grain emulsions have been formed by the process of the present invention they can be shelled to produce a core-shell emulsion by procedures well known to those skilled in the art. Any photographically useful silver salt can be employed in forming shells on the high aspect ratio tabular grain emulsions prepared by the present process. Techniques for forming silver salt shells are illustrated by Evams et al U.S. Pat. No. 4,504,570, the disclosure of which is here incorporated by reference.

In forming the tubular grain emulsions peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during grain formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin —e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. 3,061,436, Farrell et al U.S. Pat. No. 2,816,027, Ryan U.S. Pat. Nos. 3,132,945, 3,138,461 and 3,186,846, Dersch et al U.K. Patent 1,167,159 and U.S. Pat. Nos. 2,960,405 and 3,436,220, Geary U.S. Pat. No. 3,486,896, Gazzard U.K. Patent 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Patent 1,186,790, Hori et al U.K. Patent 1,489,080 and Belgian Patent 856,631, U.K. Patent 1,490,644, U.K. Patent 1,483,551, Arase et al U.K. Patent 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Patent 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Patent 15,727, Stevens U.K. Patent 1,062,116 and Yamamoto et al U.S. Pat. No. 3,923,517.

When silver bromoiodide high aspect ratio tabular grain emulsions according to the invention are being prepared in which the mean tabular grain thickness of up to about 0.06 μm, particularly less than 0.05 μm, it is preferred to employ gelatin and gelatin derived peptizers containing less than 30 micromoles per gram methionine. The methionine content can be reduced by treatment of the peptizer with an oxidizing agent, such as hydrogen peroxide. The teachings of Daubendiek et al U.S. Pat. Nos. 4,672,027 and 4,693,964 are particularly applicable. Although not essential, the reduction or elimination of methionine from the peptizer facilitates achieving very thin tabular grain structures.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Patent 774,054, Ream et al U.S. Pat. No. 3,287,289, Smith U.K. Patent 1,466,600, Stevens U.K. Patent 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. No. 2,865,893 and 2,875,059, Rees et al U.S. Pat. No. 3,536,491, Broadhead et al U.K. Patent 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Patents 808,227 and '228, Wood U.K. Patent 822,192 and Iguchi et al U.K. Patent 1,398,055. These additional materials need not be present in the reaction vessel during precipitation, but rather are conventionally added to the emulsion prior to coating. The vehicle materials, including particularly the hydropholic colloids, as well as the hydrophobic materials useful in combination therewith can be employed not only in the emulsion layers of photographic elements, but also in other layers, such as overcoat layers, interlayers and layers positioned beneath the emulsion layers.

As discussed above, ripening can occur during the hold stage of emulsion preparation. However, ripening need not and commonly is not confined to just this one stage of emulsion preparation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The silver bromoiodide high aspect ratio tabular grain emulsions of the present invention are preferably washed to remove soluble salts. Conventional washing procedures, such as those disclosed in *Research Disclosure*, Vol. 176, Dec. 1978, Paragraph II, here incorporated by reference, are contemplated.

In accordance with established practices within the art it is specifically contemplated to blend the high aspect ratio tabular grain emulsions prepared by the process of the present invention with each other or with conventional emulsions to satisfy specific emulsion requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape between its toe and shoulder. To accomplish this the emulsions of this invention can be blended with conventional silver halide emulsions, such as those described in *Research Disclosure*, Item 17643, cited above, Paragraph I. When a relatively fine grain silver chloride emulsion is blended with the silver bromoiodide emulsions of the present invention, a further increase in the sensitivity—i.e., speed-granularity relationship—of the emulsion can result.

Once silver bromoiodide high aspect ratio tabular grain emulsions have been prepared by the process of the present invention, they can be further modified, coated, exposed, and processed following procedures well known to those skilled in the art. The emulsions prepared by the present process can be chemically sensitized, as described in *Research Disclosure*, Item 17643, cited above, Paragraph III, here incorporated by reference. The emulsions can be spectrally sensitized and/or desensitized, as described in Paragraph IV. It is specifically preferred to substantially optimally chemically and spectrally sensitize the emulsions prepared by the present process by the techniques disclosed in Kofron et al, and Maskasky U.S. Pat. No. 4,435,501, cited above, both of which are here incorporated by reference.

The photographic emulsions can contain brighteners, antifoggants, stabilizers, scattering or absorbing materials, hardeners, coating aids, plasticizers, lubricants, and matting agents, as described in Item 17643, Paragraphs V, VI, VIII, X, XI, XII, and XVI. Methods of addition and coating and drying procedures can be employed, as described in Paragraphs XIV and XV. Conventional photographic supports can be employed, as described in Paragraph XVII. The photographic elements produced can be black-and-white or, preferably, color photographic elements which form silver images and/or dye images through the selective destruction, formation, or physical removal of dyes, as described in Paragraph VII. Specifically preferred color photographic elements are those which form dye images through the use of color developing agents and dye-forming couplers. To put the photographic elements to use, they can be conventionally exposed, as described in Paragraph XVIII, and they can be conventionally processed, as described in Paragraph XIX.

The following eight emulsion examples illustrate the invention. The first four examples illustrate the trade-off between reduced polydispersity and average tabular grain thickness. The next two examples, 5 and 6, illustrate the invention where polydispersity is reduced with little or no thickness increase by reducing temperature with small decreases in the level of excess bromide (increases in pBr). The last two examples, 7 and 8, show the difference between raising the temperature and lowering the temperature after the ripening step without changing the pBr. The Example 8 where the temperature was lowered shows a thinner emulsion with a lower coefficient of variation of the tabular grain population.

EXAMPLES

Emulsion Example 1 (Control)

This is an example of a silver bromoiodide high aspect ratio emulsion made with gelatin which has been oxidized to remove methionine and contains a short duration nucleation step to reduce the polydispersity.

To a well-stirred 18-liter stainless steel reaction vessel containing 6.0 liters of 0.125 percent oxidizing agent treated (less than 30 micromoles per gram residual unoxidized methionine) gelatin solution containing 0.04 moles of sodium bromide at 45° C. with pH adjusted to 1.85 using sulfuric acid, 8.0 ml of 1.67M silver nitrate was added by single jet addition at approximately 5000 ml per minute. The temperature was then increased to 60° C. over 9 minutes and held for an additional 9 minutes. This was followed by the addition of 100 g of the oxidizing agent treated gelatin and a pH adjustment to 5.85 with 2.5M sodium hydroxide. The pBr was then adjusted to 1.75 using a 1.0M sodium bromide solution. A triple jet addition of 1.6M silver nitrate at 12.5 ml per minute, 0.048M silver iodide Lippman emulsion suspension at 12.5 ml per minute, and a 1.75M sodium bromide solution used to maintain pBr at 1.75 was conducted for 40 minutes. The solution addition was then stopped and the pBr was adjusted to 1.55 with the 1.75M sodium bromide solution. This was followed by a triple jet addition of the previously described solutions with a linearly accelerated flow from 12.5 ml per minute to 120 ml per minute over 50 minutes. This yielded 6 moles of a silver bromoiodide very thin tabular emulsion which was coagulated and washed by the procedures of Yutzy et al U.S. Pat. No. 2,614,929.

The resultant silver bromoiodide high aspect ratio tabular emulsion grain had an average grain diameter of 2.6 μm and an average tubular grain thickness of 0.04 μm, an aspect ratio of 65 and an area weighted coefficient of variation of the total grain population of 55. The quotient of the average aspect ratio divided by the average thickness was 1.18.

Emulsion Example 2 (Control)

This emulsion illustrates the reduction in polydispersity and the increase in average tabular grain thickness when the pBr during the linearly accelerated triple jet addition is at 1.85.

The procedure for this emulsion was identical to Example 1 except that the pBr was maintained at 1.85 rather than 1.55 during the linearly accelerated triple jet addition. The resultant silver bromoiodide high aspect ratio tabular grain emulsion had an average grain diameter of 2.3 μm, an average tabular grain thickness of 0.045 μm, an average aspect ratio of 61, and an average coefficient of variation based on total grain population of 44. The quotient of the average aspect ratio divided by the coefficient of variation was 1.16.

Emulsion Example 3 (Control)

This emulsion illustrates the reduction in polydispersity and the increase in average tabular grain thickness which results from increasing the pBr during the linearly accelerated triple jet addition to 2.15.

The procedure for precipitation of this emulsion is identical to emulsions 1 and 2 except that the pBr is adjusted and maintained at 2.15 during the linearly accelerated triple jet addition. The resultant silver bromoiodide high aspect ratio tabular grain emulsion had an average grain diameter of 1.9 μm, an average tabular grain thickness of 0.052 μm, an average aspect ratio of 23, and an average coefficient of variation based on the total grain population of 38. The quotient of the average aspect ratio divided by the coefficient of variation was 0.80.

Emulsion Example 4 (Control)

This emulsion illustrates the further reduction in polydispersity and increase in grain thickness when the pBr during the linearly accelerated triple jet addition is adjusted to 2.45.

The procedure for precipitation of this emulsion is identical to Examples 1, 2, and 3 except that the pBr during the linearly accelerated triple jet addition is adjusted and maintained at 2.45. The resulting bromoiodide high aspect ratio tabular emulsion was slightly contaminated with a secondary fine grain population due to the rate of reactant addition exceeding the maximum growth rate of the main tabular grain population. If the fine grain secondary population is ignored, the average diameter of the tabular grains is 1.8 μm, the average tabular grain thickness is 0.95 μm, the average tabular grain aspect ratio is 19, and the coefficient of the total grain population excluding the fine grain secondary population is 34. The quotient of the average aspect ratio divided by the coefficient of variation is 0.56.

As can be seen from emulsions 1–4, as the excess bromide during growth is decreased (pBr is increased), the coefficient of variation of the emulsions decreases as described by Bryant and Zola European Patent Application EP 0 362 699 except that this is accompanied by large increases in the tabular grain thickness.

The following examples will illustrate that the coefficient of variation can be reduced without large increases in grain thickness by combining small reductions in the excess bromide and reduction in temperature during the growth phase of the emulsion precipitation.

Emulsion Example 5 (Invention)

This emulsion illustrates the reduction in polydispersity with no increase in grain thickness observed by increasing the pBr to 1.7 and reducing the temperature to 45° C. during the linearly accelerated triple jet addition.

The procedure for precipitation of this emulsion is identical to that described in emulsion 1 except that the pBr is adjusted and maintained at 1.70 and the temperature is reduced and maintained at 45° C. during the linearly accelerated triple jet addition. The resultant silver bromoiodide high aspect ratio tabular emulsion had an average grain diameter of 2.2 μm, an average tabular grain thickness of 0.04 μm, an average aspect ratio of 55, and an average coefficient of variation of the total grain population of 42. The quotient of the average aspect ratio divided by the coefficient of variation was 1.31.

Emulsion Example 6 (Invention)

This emulsion illustrates the reduction in polydispersity with only a small increase in grain thickness observed when the pBr is increased to 1.8 and the temperature is reduced to 35° C. during the linearly accelerated triple jet addition phase of the precipitation.

The procedure for precipitating this emulsion is identical to that described in the previous examples except that the pBr is adjusted and controlled at 1.8 and the temperature is adjusted and maintained at 35° C. during the linearly accelerated triple jet addition. The resultant silver bromoiodide high aspect ratio tabular emulsion had an average grain diameter of 2.2 μm, an average tabular grain thickness of 0.045 μm, an average aspect ratio of 49, and a coefficient of variation of the total grain population of 42. The quotient of the aspect ratio divided by the coefficient of variation was 1.16.

Emulsions 5 and 6 show that a combination of reduction in temperature with small decreases in excess halide (increases in pBr) result in significant reductions in the coefficient of variation of the total grain population without the large increases in average tabular grain thickness that were seen in Examples 3 and 4.

It has also been found that reducing the temperature during the growth stage of the precipitation from a higher temperature used during a ripening stage before growth without adjusting the excess halide level (pBr) will produce a combined effect of decreasing the average tabular grain thickness and reducing the coefficient of variation of the tabular grain population.

Emulsion Example 7 (Control)

This emulsion illustrates the effect of raising temperature during the growth of the emulsion from a lower point where the initial grain population was ripened before growth.

To a well-stirred, 18-liter stainless steel reaction vessel containing 6.0 liters of 0.125 percent oxidizing agent treated gelatin solution containing 0.04 moles of sodium bromide at 45° C. with pH adjusted to 1.85 using sulfuric acid, 8.0 ml of 2.0M silver nitrate along with 8.0 ml of a 2.0M solution containing 98.5 mole percent sodium bromide and 1.5 mole percent potassium iodide were added by double jet addition at 120 ml per minute. This was followed by a 1-minute hold after which the pBr was adjusted to 1.75 using a 1.0M sodium bromide solution. The temperature was then increased to 60° C. over 9 minutes, followed by a 5-minute ripening hold time. The temperature was then raised to 75° C. over 9 minutes during which 100 grams of oxidizing agent treated gelatin was added and the pH was adjusted to 5.85 with sodium hydroxide. A triple jet addition of 1.6M silver nitrate at 12.5 ml per minute, 0.048M silver iodide lippman emulsion suspension at 12.5 ml per minute, and a 1.75M sodium bromide solution used to maintain the pBr at 1.75 was conducted for 20 minutes. The pBr was then adjusted to 2.15 and the triple jet addition was continued for an additional 20 minutes at 12.5 ml per minute with the pBr maintained at 2.15. This was followed by triple jet addition of the previously described solutions with a linearly accelerated flow from 12.5 ml per minute to 120 ml per minute over 50 minutes. This yielded 6 moles of a silver bromoiodide high aspect ratio tabular emulsion which was coagulated and washed by the procedures of Yutzy et al U.S. Pat. No. 2,614,929.

The resultant silver bromoiodide high aspect ratio tabular emulsion had an average grain diameter of 2.4 μm, an average tabular grain thickness of 0.10 μm, an average aspect ratio of 24, and a coefficient of variation of the tabular grain population of 43. The quotient of the average aspect ratio divided by the coefficient of variation was 0.56.

Emulsion Example 8 (Control)

This emulsion illustrates how lowering the temperature during the triple jet addition from the higher temperature used during the ripening stage before growth reduced both the average tabular grain thickness and the coefficient of variation.

The procedure for precipitation of this emulsion is identical to that described for emulsion 7 except that rather than raising the temperature to 75° C. over 9 minutes before the beginning of the triple jet additions, the temperature is lowered to 45° C.

The resultant silver bromoiodide high aspect ratio tabular emulsion had an average grain diameter of 1.9 μm, an average tabular grain thickness of 0.07 μm, an average aspect ratio of 27, and a coefficient of variation of the tabular grain population of 34. The quotient of the average aspect ratio divided by the coefficient of variation was 0.79.

The invention has been described in detail with particular reference to preferred embodiments thereof, but it will be understood that variations and modifications can be effected within the spirit and scope of the invention.

I claim:

1. A method of forming silver halide grains comprising forming an initial population of small twin plane silver halide grains in an aqueous medium in less than about 1 minute, allowing ripening at a temperature greater than or equal to the temperature of forming said initial population, growing the ripened grains, with the proviso that during between about 30% and 100% of growth said aqueous medium temperature is lowered between about 5° C. and 30° C. below said ripening temperature but above the temperature of renucleation, the pBr is between about 1.5 and 2.5 during growth, said initial population of silver halide grains are comprised of between 0 and about 5% iodine halide and between about 5% and 100% of bromine halide, and during growth iodide is rapidly added to said aqueous medium as a Lippman emulsion after about 5% to about 90% of the total silver has been added to the aqueous solution.

2. The method of claim 1 wherein said initial population of silver halide grains comprises silver bromide.

3. The method of claim 1 wherein ripening is carried out between about 30° C. and about 90° C.

4. The method of claim 1 wherein ripening is carried out at between about 45° C. and 80° C.

* * * * *